US006378476B2

(12) United States Patent
Okada et al.

(10) Patent No.: US 6,378,476 B2
(45) Date of Patent: Apr. 30, 2002

(54) VALVE TIMING ADJUSTING DEVICE

(75) Inventors: Motohiro Okada, Obu; Akihiko Takenaka, Anjo; Osamu Sato, Takahama, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/887,006

(22) Filed: Jun. 25, 2001

(30) Foreign Application Priority Data

Jun. 23, 2000 (JP) ..... 2000-188879

(51) Int. Cl.[7] ..... F01L 1/344
(52) U.S. Cl. ..... 123/90.17
(58) Field of Search ..... 123/90.15, 90.17, 123/90.31

(56) References Cited

U.S. PATENT DOCUMENTS 6,105,543 A * 8/2000 Ogawa ..... 123/90.17
6,334,414 B1 1/2002 Okada et al. ..... 123/90.15

FOREIGN PATENT DOCUMENTS

JP 2000-345816 12/2000

* cited by examiner

*Primary Examiner*—Weilun Lo
(74) *Attorney, Agent, or Firm*—Nixon & Vanderhye P.C.

(57) ABSTRACT

A stopper piston is fitted into a fitting hole when a vane rotor is located at an approximately intermediate position between a most retard position and a most advance position with respect to a shoe housing. When the stopper piston is fitted into the fitting hole, a relative rotation of the vane rotor with respect to the shoe housing is restrained. When the stopper piston rotates to an advance side with respect to the shoe housing over the intermediate position at which the stopper piston is fitted into the fitting hole, a damper chamber communicates with an advance oil pressure chamber through a through hole, an oil passage and a recess space. When the vane rotor rotates to a retard side including the intermediate position, the damper chamber is sealed hermetically, and therefore the moving speed of the stopper piston toward the fitting hole decreases.

16 Claims, 6 Drawing Sheets

VALVE TIMING ADJUSTING DEVICE

CROSS REFERENCE TO RELATED APPLICATION

This application is based on and incorporates herein by reference Japanese Patent Application No. 2000-188879 filed on Jun. 23, 2000.

BACKGROUND OF THE INVENTION

1. Field of the Invention

The present invention relates to a valve timing adjusting device for changing valve opening-closing timing suitable for use in intake and exhaust valves of an internal combustion engine.

2. Description of the Prior Art

As a conventional valve timing adjusting device, there is a well known vane-type device in which a camshaft is driven through a timing pulley, a chain sprocket, etc. which turn synchronously with an engine crankshaft. The valve timing of at least any one of an intake valve and an exhaust valve is hydraulically controlled by a phase difference of relative rotation of the timing pulley, the chain sprocket, and the camshaft. Engine output and fuel consumption ratio are improved by adjusting the phase difference between the crankshaft and the camshaft to an optimum value in accordance with engine operating state.

In such a vane-type valve timing adjusting device using operation oil, when at least any one of the intake valve and the exhaust valve is actuated, the camshaft receives a load torque which varies between positive and negative loads. Therefore, when the operation oil is not sufficiently supplied during cranking of the engine, there might arise such a problem that a vane member oscillates with respect to a housing member containing the vane member, thereby hitting against the housing member to produce knocks. Here, the positive load torque is applied in the retarding direction of the camshaft with respect to the crankshaft, and the negative load torque is added in the advancing direction of the camshaft with respect to the crankshaft.

When operation fluid is not sufficiently supplied to the valve timing adjusting apparatus, a stopper piston included in a vane member is fitted into a fitting hole formed in a housing member to prevent a swing motion of the vane member against the housing member, thereby preventing the occurrence of the noise. When the operation fluid is supplied sufficiently, the stopper piston comes out of the housing member by the fluid pressure, so that a relative rotation of the vane member is controlled with respect to the housing member. The position at which the stopper piston is fitted into the fitting hole may be either a most retard or most advance position of the vane member with respect to the housing member or an intermediate position between the most retard and most advance positions.

However, when the stopper piston is fitted into the fitting hole during the relative rotation control, the relative rotation control is not executed. For avoiding such an inconvenience, a damper chamber is provided on an outer periphery of the stopper piston, thereby decreasing the speed of movement of the stopper piston toward the fitting hole.

When the engine is stopped, the stopper piston is desired to be fitted into the fitting hole promptly. However, when the damper chamber is hermetically sealed, a damping action exerts even when the stopper piston has reached a position where the stopper piston is fitted into the fitting hole, so that the moving speed of the stopper piston decreases and the stopper piston does not promptly fit in the fitting hole. For example, in a configuration wherein the stopper fin is fitted into the fitting hole at an advance side with respect to the most retard position, the stopper pin might pass over the fitting hole without being fitted therein due to the action of a load torque acting on the retard side.

SUMMARY OF THE INVENTION

A first object of the present invention is to provide a valve timing adjusting device which restrains a relative rotation of a driven-side rotor with respect to a driving-side rotor when an engine is stopped.

A second object of the present invention is to provide a valve timing adjusting device which prevents the relative rotation of the driven-side rotor with respect to the driving rotor from being restrained when the engine operates normally.

According to a first aspect of the present invention, a valve timing adjusting device includes a changeover means which causes a damper chamber to be opened when a driven-side rotor is positioned at an advance side over a predetermined angle position of a contacting portion with respect to a driving-side rotor and which causes the damper chamber to be sealed hermetically when the driven-side rotor is positioned at the predetermined angle position or at retard side over the predetermined angle position with respect to the driving-side rotor.

When the contacting portion is positioned at the predetermined angle position, the damper chamber is sealed hermetically and the speed of movement of the contacting portion in its contacting direction decreases. Thus, when the engine normally operates, the contacting portion does not contact the contacted portion even when a fluid pressure which the contacting portion receives in a contact-canceling direction at the contacting position changes, thereby preventing a relative rotation of the driven-side rotor with respect to the driving-side rotor from being restrained.

When the engine is stopped, if the driven-side rotor is positioned at an advance side over the predetermined angle position with respect to the driving-side rotor, the damper chamber is opened. Then, upon turning OFF of the engine, the fluid pressure applied to the contacting portion in the contact-canceling direction drops. Therefore, when the driven-side rotor rotates to the retard side toward the predetermined angle position due to a load torque which is applied until the engine stop, the contacting portion contacts the contacted portion. Thus, a relative rotation of the driven-side rotor with respect to the driving-side rotor is restrained when the engine starts.

According to a second aspect of the present invention, fluid chambers facing a contacting portion are all opened except a damper chamber. Thus, the other fluid chambers than the damper chamber do not act as damper chambers. Therefore, when the engine is stopped, the contacting portion contacts the contacted portion when the driven-side rotor reaches the predetermined angle position, thereby restraining a relative rotation of the driven-side rotor with respect to the driving-side rotor.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENT

Figure 3:
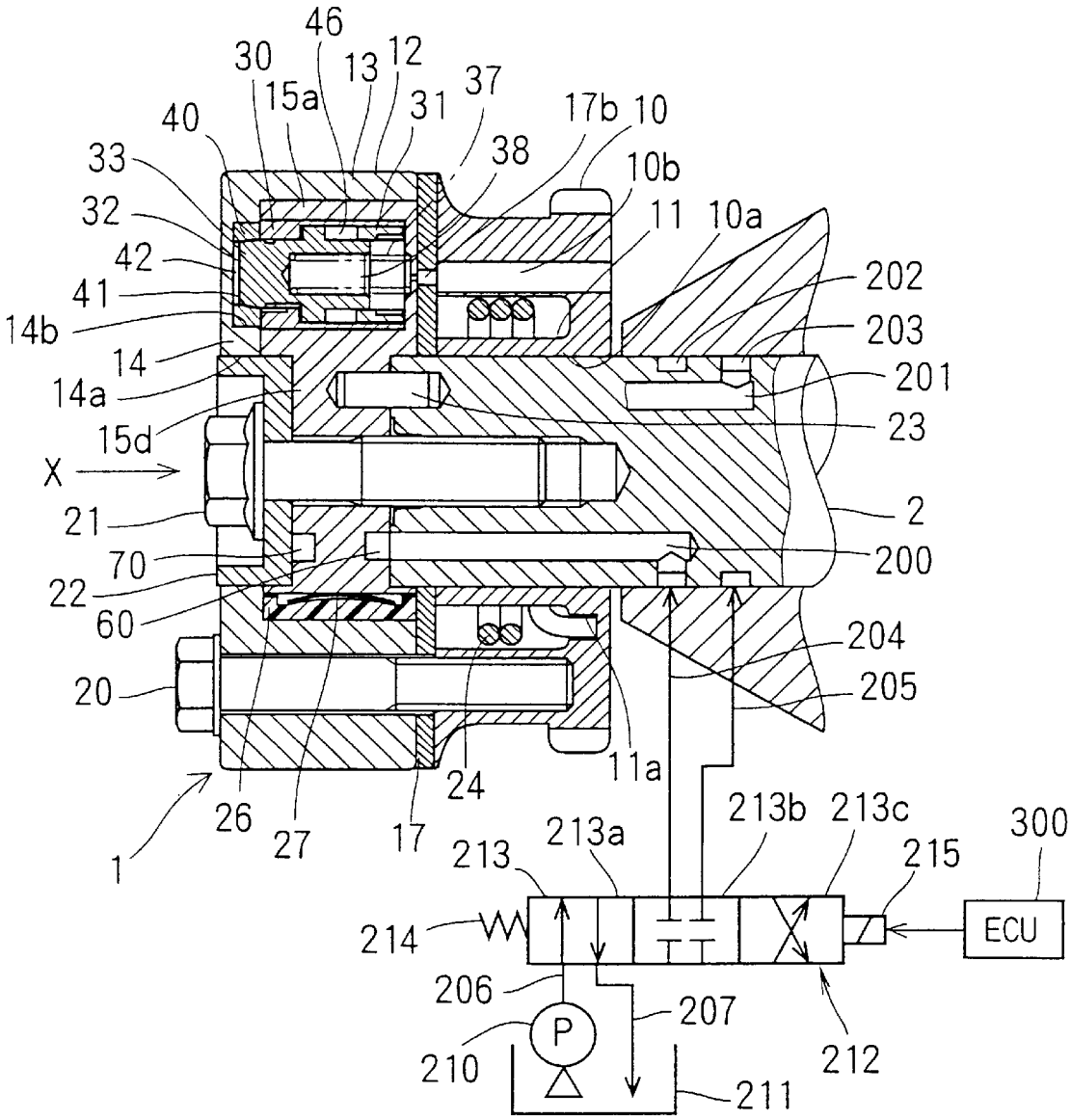
FIG. 3 is a cross-sectional view taken along line III—III in FIG. 2.

FIG. 3 shows an engine valve timing adjusting device 1 of the present embodiment. The valve timing adjusting device 1 is of an oil pressure control type and controls an intake valve timing.

A chain sprocket 10 is connected to a crankshaft as a drive shaft of the engine and receives a driving force through a chain. The chain sprocket 10 rotates in synchronization with the crankshaft. The driving force is transmitted to the camshaft 2 as a driven shaft through the chain sprocket 10. The camshaft opens and closes the intake valve. The camshaft 2 is rotatable with respect to the chain sprocket 10 by a predetermined phase difference. The chain sprocket 10 and the camshaft 2 rotate clockwise as viewed in the direction of the arrow X in FIG. 3. Hereinafter, this rotating direction defines an advance direction.

Between the chain sprocket 10 and a set of shoe housing 12 and vane rotors 15, a disk-shaped intermediate plate 17 is provided. The intermediate plate 17 prevents oil leaks from between the chain sprocket 10 and the set of shoe housing 12 and vane rotors 15. The chain sprocket 10, the shoe housing 12, and the intermediate plate 17 form a housing member and works as a driving-side rotor, and coaxially secured by a bolt 20.

Figure 2:
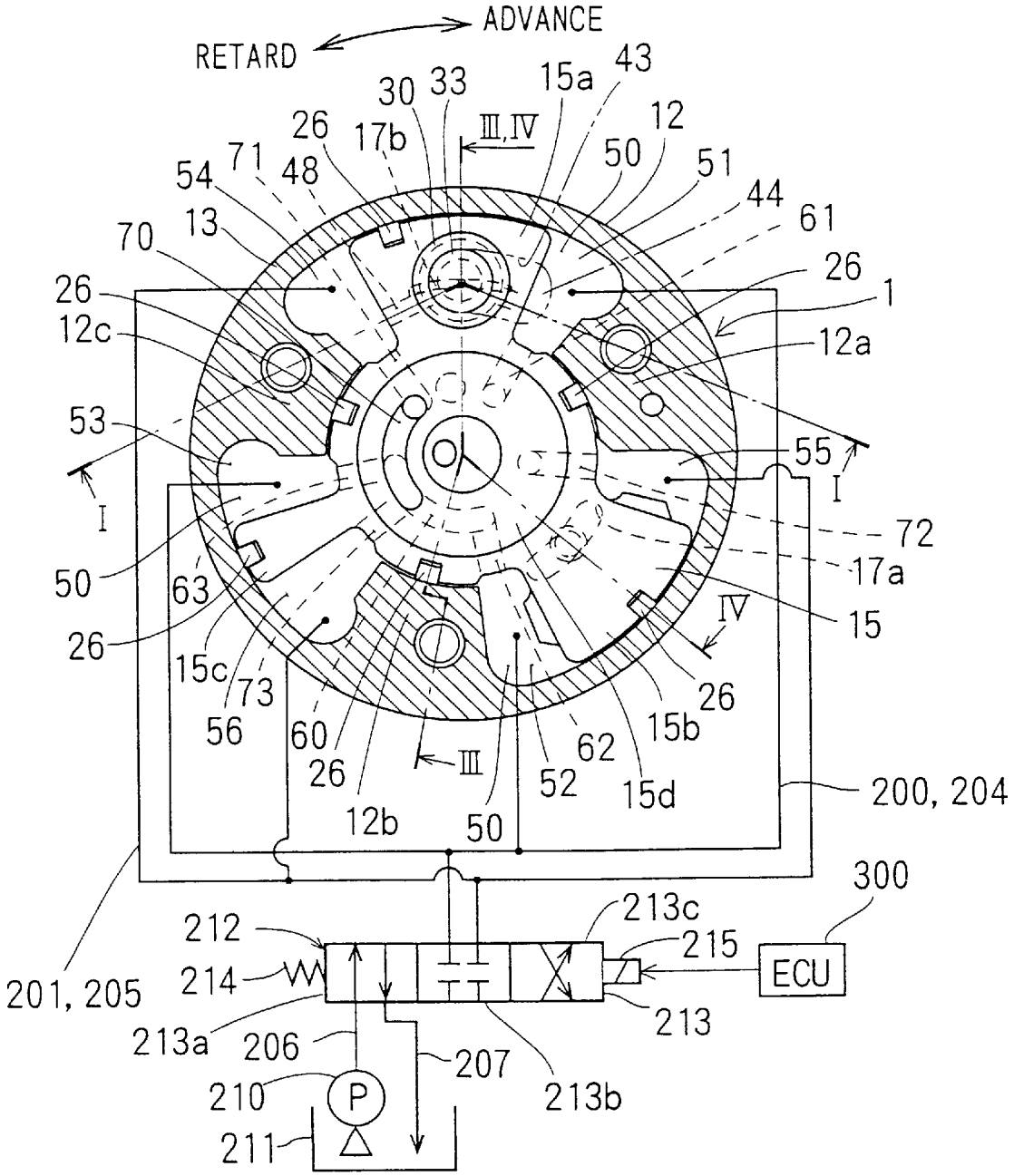
FIG. 2.is a cross-sectional view showing the valve timing adjusting device.

The shoe housing 12 integrally includes a side wall 13 and a front plate 14. As shown in FIG. 2, the shoe housing 12 includes shoes 12*a,* 12*b* and 12*c* formed in a trapezoidal shape and circumferentially arranged at approximately equal spacing intervals. In three spaces provided in the circumferential direction of the shoes 12*a,* 12*b* and 12*c,* housing chambers 50 for containing vanes 15*a,* 15*b* and 15*c* are formed. The inner peripheral surfaces of the shoes 12*a,* 12*b* and 12*c* are formed in an arc in cross section.

The vane rotor 15 includes vanes 15*a,* 15*b* and 15*c* arranged at approximately equal spacing intervals in the circumferential direction. The vanes 15*a,* 15*b* and 15*c* are rotatably accommodated within each of housing chambers 50. Each vane divides the housing chamber 50 into a retard hydraulic fluid chamber and an advance hydraulic fluid chamber. Arrows in FIG. 2 indicating retard and advance directions indicate the retard and advance directions of the vane rotor 15 with respect to the shoe housing 12. The most retarded position of the vane rotor 15 with respect to the shoe housing 12 is determined by contact of the vane 15*b* with the shoe 12*a*. The most advanced position of the vane rotor 15 with respect to the shoe housing 12 is determined by contact of the vane 15*b* with the shoe 12*b*. As shown in FIG. 3, the vane rotor 15 and a bushing 22 are integrally fixed by a bolt 21 on the camshaft 2, and form a driven-side rotor. A pin 23 determines the positioning of the vane rotor 15 in the rotational direction with respect to the camshaft 2.

The camshaft 2 and the bushing 22 are correlatively rotatably fitted in the inner wall 10*a* of the chain sprocket 10 and in the inner wall 14*a* of the front plate 14. Therefore, the camshaft 2 and the vane rotor 15 are coaxially correlatively rotatable with respect to the chain sprocket 10 and the shoe housing 12. The inner wall 10*a* of the chain sprocket 10 and the inner wall 14*a* of the front plate 14 work as bearings for supporting the driven-side rotor.

Figure 4:
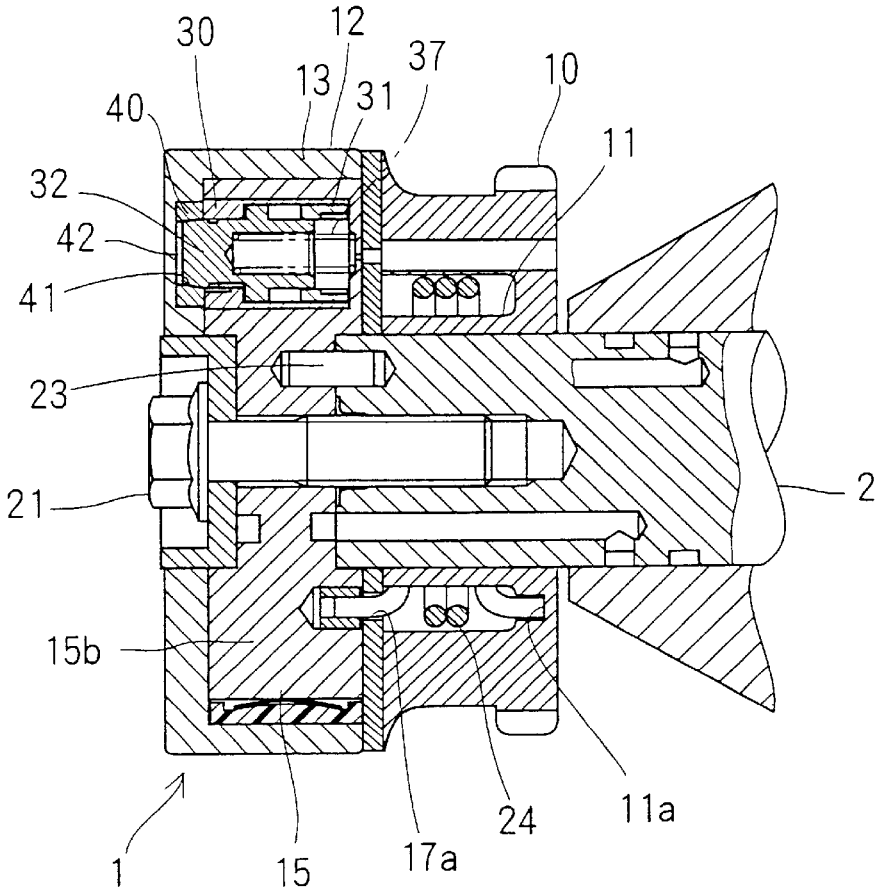
FIG. 4 is a cross-sectional view taken along line IV—IV in FIG. 2.

A spring 24 is installed in a cylindrical recess 11 formed in the chain sprocket 10. The spring 24 is retained at one end by the retaining portion 11*a* of the recess 11 and at the other end by the vane rotor 15 as shown in FIG. 4 through a long hole 17*a* formed in the intermediate plate 17 shown in FIGS. 2 and 4.

The load torque which the camshaft 2 receives while driving the intake valve varies to both positive and negative sides. Here, the positive direction of the load torque is the retard direction of the vane rotor 15 with respect to the shoe housing 12, while the negative direction of the load torque is the advance direction of the vane rotor 15 with respect to the shoe housing 12. An average load torque is applied in the positive direction, that is, in the retard direction. The urging force of the spring 24 works as a torque to rotate the vane rotor 15 to the advance side with respect to the shoe housing 12. The torque of the spring 24 acting on the vane rotor 15 in the advance direction is almost the same as the average load torque acting on the camshaft 2.

A seal member 26 is fitted in the outer peripheral wall of the vane rotor 15 as shown in FIG. 2. Between the outer peripheral wall of the vane rotor 15 and the inner peripheral wall of the side wall 13, a very small clearance is provided. The seal member 26 prevents the hydraulic fluid from leaking between the hydraulic fluid chambers through the clearance. The seal member 26 is pressed toward the side wall 13 by the force of the plate spring 27 shown in FIG. 3.

Figure 1:
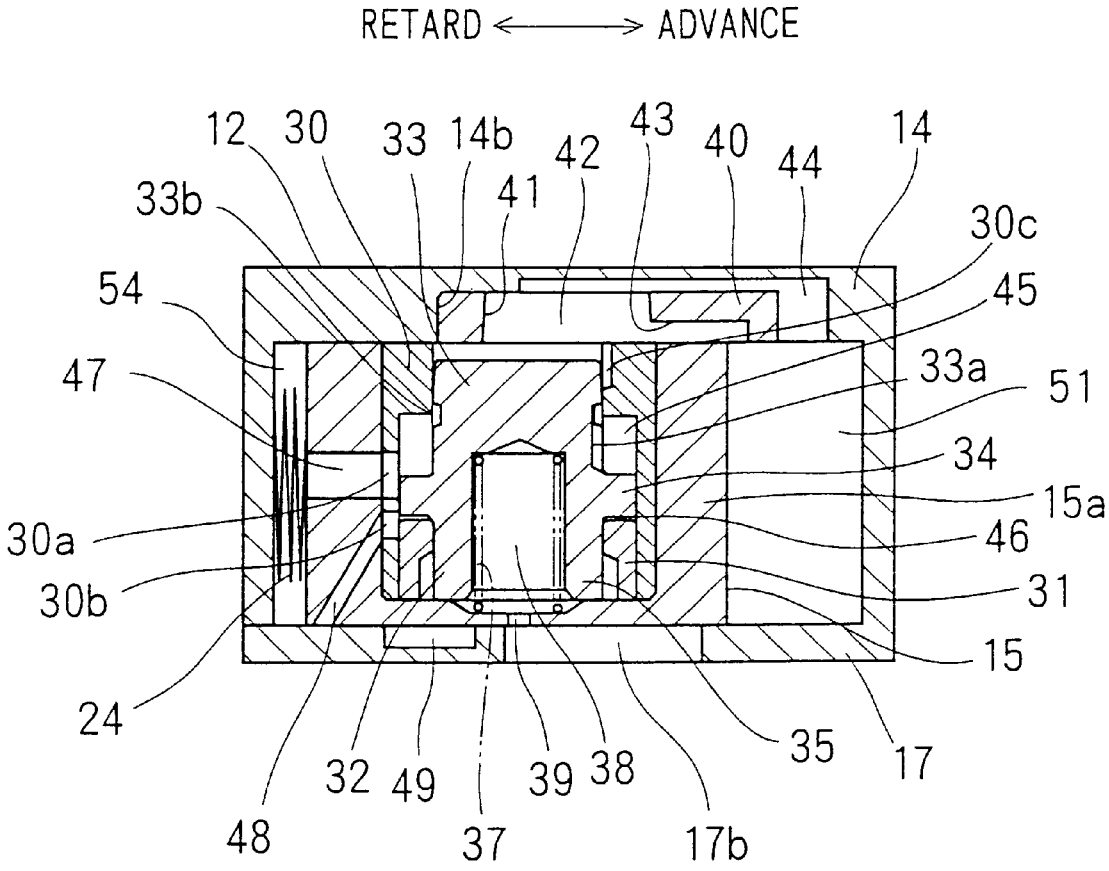
FIG. 1 is a schematic view showing a cross-sectional view taken along line I—I in FIG. 2 showing a valve timing adjusting device.

A guide ring 30 is pressed and retained in the inner wall of the vane 15*a* forming the housing hole 38. A guide ring 31 is pressed and retained in the inner wall of the guide ring 30. A cylindrical stopper piston 32 as a contacting portion is provided in the guide rings 30 and 31, and is slidable in the axial direction of the camshaft 2. A fitting member 40 as a contacted portion formed in a circle in cross section is pressed and retained in recess 14*b* formed in the front plate 14. As shown in FIG. 1, in the fitting member, 40, a fitting hole 41 in which the stopper piston 32 can be fitted to contact the fitting member 40, and an enlarged hole 43 extended on the advance side which is shallower than the fitting hole 41, and has a retard-side end face on the same plane as the retard-side end face of the fitting hole 41.

The stopper piston 32 is formed in a cylindrical shape having a bottom and has a first small-diameter portion 33, a large-diameter portion 34, and a second small-diameter portion 35 as viewed from the fitting member 40. The first small-diameter portion 33 is tapered as it goes toward the fitting direction. Since the fitting hole 41 is also tapered at approximately the same angle of taper as the inclination of the first small-diameter portion 33, the stopper piston 32 can smoothly fit in the fitting hole 41. Furthermore, since the stopper piston 32 tightly fits in the fitting hole 41, it is possible to prevent occurrence of knocks likely to be produced by load torque variations. Furthermore, since the first small-diameter portion 33 being in contact with the fitting hole 41, has a large contact surface area, the first small-diameter portion 33 receives small stress, thereby improving a durability of the stopper piston 32.

A spring 37 in FIG. 1 urges the stopper piston 32 toward the fitting member 40. A restraining means in the present invention includes the stopper piston 32, the fitting member 40 and the spring 37.

The first small-diameter portion 33 of the stopper piston 32 can fit in the fitting hole 41 when the vane rotor 15 is nearly in the intermediate position between the most retarded position and the most advanced position with respect to the shoe housing 12 as shown in FIG. 2. When the stopper piston 32 is fitted in the fitting hole 41, the relative rotation of the vane rotor 15 with respect to the shoe housing 12 is restrained. In the intermediate position, the relative rotation of the vane rotor 15 with respect to the shoe housing 12 is restrained with the stopper piston 32 fitted in the fitting hole 41. In this intermediate position, the phase difference of the camshaft 2 from the crankshaft, that is, the intake valve timing is set in optimum such that the engine can be reliably started up.

When the stopper piston 32 is withdrawn out of the fitting hole 41, the vane rotor 15 is relatively rotatable with respect to the shoe housing 12.

The front end face of the first small-diameter portion 33 receives the retard oil pressure from an oil pressure chamber 42. Annular surface formed on the fitting hole 41 side of the large-diameter portion 34 receives an advance oil pressure from an oil pressure chamber 45 when an oil passage 47 formed by the oil pressure chamber 45 and the vane 15*a* is not closed by the large-diameter portion 34. The oil pressure that the stopper piston 32 receives from the oil pressure chambers 42 and 45 are applied in the direction in which the stopper piston 32 moves out of the fitting hole 41. The oil pressure chamber 42 communicates with a retard oil pressure chamber 51 through an oil passage 44 formed within the front plate 14. The oil pressure chamber 45 can communicate with an advance oil pressure chamber 54 through a through hole 30*a* formed in the guide ring 30 and an oil passage 47.

A damper chamber 46 communicates with an oil passage 48 through a through hole 30*b* formed in the guide ring 30. The oil pressure chambers 42, 45, the damper chamber 46, and the housing hole 38 face to the stopper piston 32. A recess space 49 is formed on the sliding side of the intermediate plate 17 on which the vane 15*a* slides. The oil passage 48 and the recess space 49 form a communication passage. The recess space 49 can communicate with the advance oil pressure chamber 54 and the oil passage 48, that is, with the damper chamber 46, in accordance with the relative rotational position of the vane rotor 15 with respect to the shoe housing 12. The connection of the advance oil pressure chamber 54 with the damper chamber 46 is interrupted by the sliding surface of the vane rotor 15 and the intermediate plate 17. That is, the vane rotor 15 and the intermediate plate 17 work as switching means for switching the damper chamber 46 between opened and sealed. The advance oil pressure chamber 54 communicates with the damper chamber 46 through the recess space 49 when the vane rotor 15 rotates to the advance side with respect to the shoe housing 12 over the intermediate position where the stopper piston 32 fits in the fitting hole 41.

When the damper chamber 46 is disconnected from the advance oil pressure chamber 54, the damper chamber 46 is hermetically sealed. When the damper chamber 46 is hermetically sealed, the damper chamber 46 operates as a damper to decrease the speed of movement of the stopper piston 32 toward the fitting hole 41. The damper chamber 46 is opened when the damper chamber 46 communicates with the advance oil pressure chamber 54. When the damper chamber 46 is opened and ceases to function as a damper, the stopper piston 32 can easily move toward the fitting hole 41. In this way, the opening and hermetically sealing of the damper chamber 46 is changed over by the relative rotational position of the vane rotor 15.

Figure 5:
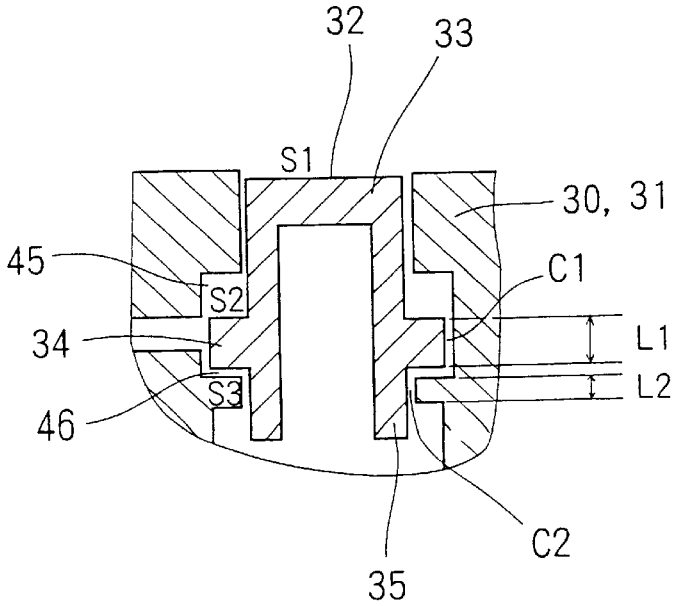
FIG. 5 is a schematic cross-sectional view showing a stopper piston and a guide ring.

FIG. 5 schematically shows pressure receiving areas of the stopper piston 32. FIG. 5 shows seal lengths and clearances between the stopper piston 32 and the guide rings 30, 31. Here, it is defined that the pressure receiving area at which the first small-diameter portion 33 receives a retard oil pressure from the oil pressure chamber 42 is S1, the pressure receiving area at which the large-diameter portion 34 receives an advance oil pressure from the oil pressure chamber 45 is S2, and the pressure receiving area at which the large-diameter portion 34 receives an advance oil pressure from the damper chamber 46 is S3. In the present embodiment, $S1 \approx S2 \approx S3$.

The retard oil pressure in the oil pressure chamber 42 and the advance oil pressure in the oil pressure chamber 45 are pulsated and phases thereof are inverted each other. Therefore, by setting $S1 \approx S2$, the magnitudes of pulsations which the stopper piston 32 receives from the oil pressures in the oil pressure chambers 42 and 45 are averaged and it is possible to prevent the vibration of the stopper piston 32.

When S2 and S3 are set to $S2 > S3$, not $S2 \approx S3$, even when the operation oil in the oil chamber 45 leaks into the damper chamber 46 through the clearance between the large-diameter portion 34 and the guide ring 30, the force which an abutting portion receives from the damper chamber 46 becomes small because the area at which the large-diameter portion 34 receives the oil pressure in the damper chamber 46 is small. Thus, it is not necessary that the size of the clearance between the large-diameter portion 34 and the guide ring 30 be set highly accurately; in other words, forming of the large-diameter portion 34 and the guide ring 30 becomes easier. However, the damping effect is diminished because the volume of the damper chamber 46 becomes small.

When S2 and S3 are set to $S2 < S3$, the volume of the damper chamber 46 becomes large and the damping effect becomes more outstanding. However, since the area at which the large-diameter portion 34 receives the oil pressure from the damper chamber 46 becomes large, it is necessary that the size of the clearance between the large-diameter portion 34 and the guide ring 30 be set highly accurately to decrease the amount of oil leaking from the oil pressure chamber 45 to the damper chamber 46. Thus, it becomes difficult to form the large-diameter portion 34 and the guide ring 30.

Therefore, by setting S2 and S3 to $S2 \approx S3$, the damping effect of the damper chamber 46 is ensured, and the large-diameter portion 34 and the guide ring 30 are easily formed without setting highly accurately the size of the clearance between the large-diameter portion 34 and the guide ring 30.

Seal length between the large-diameter portion 34 and the guide ring 30 and seal length between the second small-diameter portion 35 and the guide ring 31 are defined to be L1 and L2, respectively. Further, clearance between the large-diameter portion 34 and the guide ring 30 and clearance between the second small-diameter portion 35 and the guide ring 31 are defined to be C1 and C2, respectively. In the present embodiment, L1, L2, C1 and C3 are set to L1>L2 and C1<C2. Therefore, the amount of operation oil flowing out of the damper chamber 46 is larger than that flowing into the damper chamber 46, and the oil pressure in the damper chamber 46 does not rise.

As shown in FIG. 1, the housing hole 38 formed in the stopper piston 32 on the opposite side to the fitting member 40 is always open to the atmosphere in a relative rotational angle range of the vane rotor 15 via a through hole 39 formed in the vane 15*a,* a communication hole 17*b* formed in the intermediate plate 17 and extending in the circumferential direction, and further via an oil passage 10*b* (see FIG. 3) formed in the chain sprocket 10. Therefore, the oil pressure of the operation oil leaking out from the sliding clearance between the second small-diameter portion 35 and the guide ring 31 into the housing hole 38 is almost equal to the atmospheric pressure. Thus, the operation oil leaking out into the housing hole 38, does not act as a force for pushing the stopper piston 32 toward the fitting member 40. Further, since the housing hole 38 is always opened, no damping action occurs.

A groove 33*a* extending in the direction of movement of the stopper piston 32 is formed in an outer peripheral wall of the first small-diameter portion 33. An annular groove 33*b* is connected to the groove 33*a* is formed on the fitting hole 41 side of the groove 33*a*. Further, a groove 30*c* extending in the direction of movement of the stopper piston 32 is formed in an inner peripheral surface of the guide ring 30 which is in sliding contact with the first small-diameter portion 33. An oil passage formed by the groove 30*c* is always in communication with the oil pressure chamber 42. Oil passages formed by the grooves 33*a,* annular groove 33*b* and groove 30*c* come into communication with one another, in accordance with the position of movement of the stopper piston 32. The grooves 33*a,* annular groove 33*b* and groove 30*c* work as a communication means.

As shown in FIG. 2, a retard oil pressure chamber 51 is formed between the shoe 12*a* and the vane 15*a,* are retard oil pressure chamber 52 is formed between the shoe 12*b* and the vane 15*b,* and a retard oil pressure chamber 53 is formed between the shoe 12*c* and the vane 15*c*. Similarly, an advance oil pressure chamber 54 is formed between the shoe 12*c* and the vane 15*a,* an advance oil pressure chamber 55 is formed between the shoe 12*a* and the vane 15*b,* and an advance oil pressure chamber 56 is formed between the shoe 12*b* and the vane 15*c*.

The retard oil pressure chamber 51 communicates with an oil passage 61. The retard oil pressure chambers 52, 53 communicate through oil passages 62, 63 and with an oil passage 60 shown in FIG. 2. The oil passage 60 is formed in a C shape and at a camshaft 2-side end face of a boss portion 15*d*. The retard oil pressure chambers 51, 52 and 53 further communicate through the oil passages 60, 61 and with an oil passage 200 formed in the camshaft 2 (see FIG. 3). As shown in FIG. 2, the advance oil pressure chamber 55 communicates with an oil passage 72. The advance oil pressure chambers 54, 56 communicate through oil passages 71, 73 and with an oil passage 70. The oil passage 70 is formed in a C shape and at a bushing 22-side end face of the boss portion 15*d*. Further, the advance oil pressure chambers 54, 55, 56 communicate with an oil passage 201 formed within the camshaft 2 (see FIG. 3) through an oil passage (not illustrated) axially formed in the boss portion 15*d* from the oil passages 70, 72.

The oil passage 200 communicates with a groove passage 202 formed in an outer peripheral wall of the camshaft 2. The oil passage 201 communicates with a groove passage 203 also formed in the outer peripheral wall of the camshaft 2. The groove passages 202, 203 are connected to a change-over valve 212 through oil passages 204, 205, respectively. An oil feed passage 206 is connected to an oil pump 210, and an oil discharge passage 207 is open toward a drain 211. The oil pump 210 supplies the operation oil pumped up from the drain 211 to each oil chamber through the change-over valve 212. The change-over valve 212 is a four-port guide valve.

A valve member 213 of the change-over valve 212 is urged in one direction by means of a spring 214 and is reciprocated by controlling the supply of electric power to a solenoid 215. An engine control unit (ECU) 300 controls the supply of the electric power. Detection signals from various sensors are input into the ECU 300, and the ECU 300 outputs signals to various devices associated with an engine. Communicative combinations of the oil passages 204 and 205 with the oil feed passage 206 and the oil discharge passage 207, as well as blocking of the communication, are switched by reciprocating the valve member 213.

With the above-described oil passage configuration, the operation oil is supplied from the oil pump 210 to the retard oil pressure chambers 51, 52, 52, the advance oil pressure chambers 54, 55, 56 and the oil pressure chambers 42,45. Further, the operation oil is discharged from those oil chambers to the drain 211.

Next, an operation of the valve timing adjusting apparatus 1 will be described.

Figure 6A:
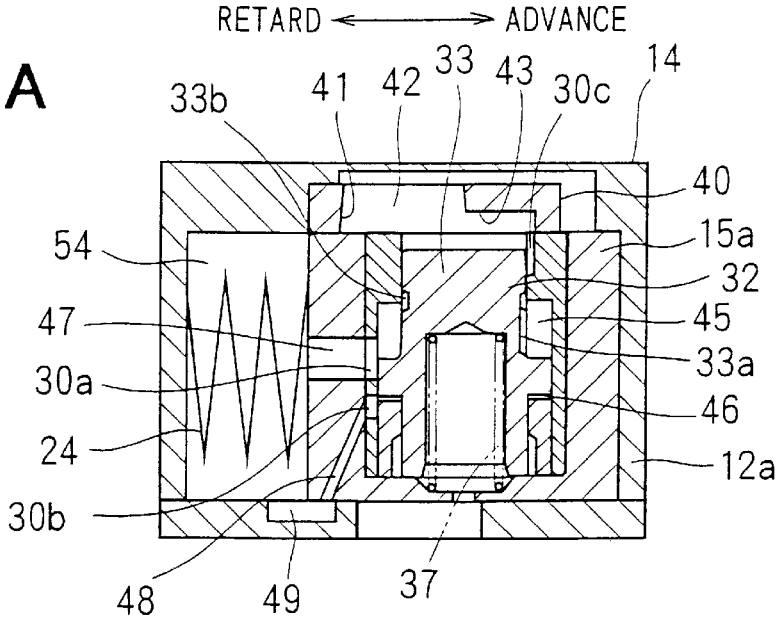
FIG. 6A is a cross-sectional view showing a released state of the stopper piston operation when an engine stops.

When an ignition key is turned OFF and engine stop is instructed, the stop of electric power to the ECU 300 is delayed by a relay circuit. When the ECU 300 detects that the ignition key has been turned OFF, it energizes the solenoid 215, so that a valve member 213*c* is selected. As a result, the operation oil is fed to the advance oil pressure chambers 54, 55, 56 and the oil pressure chamber 45, and the retard oil pressure chambers 51, 52, 53 and the oil pressure chamber 42 are open to the drain 211. Thus, the vane rotor 15 rotates to the advance side with respect to the shoe housing 12 and reaches the most advance position as shown in FIG. 6A. The ECU 300 and the change-over valve 212 work as an advance control means.

Even when the stopper piston 32 reaches the intermediate position to fit with the fitting hole 41 from the retard side, the damper chamber 46 is sealed hermetically and exhibits a damping action because the oil passage 48 does not communicate with the recess space 49. Therefore, the stopper piston 32 does not move toward the fitting hole 41. When the stopper piston 32 rotates to the advance side over the intermediate position, the damper chamber 46 communicates with the advance oil pressure chamber 54 through the recess space 49, so that the damper chamber 46 is opened and no damper action occurs. Further, since the areas at which the large-diameter portion 34 receives advance oil pressures from the oil pressure chamber 45 and the damper chamber 46 are equal to each other, the forces which the large-diameter portion 34 receives from the advance oil pressures are canceled.

Figure 6B:
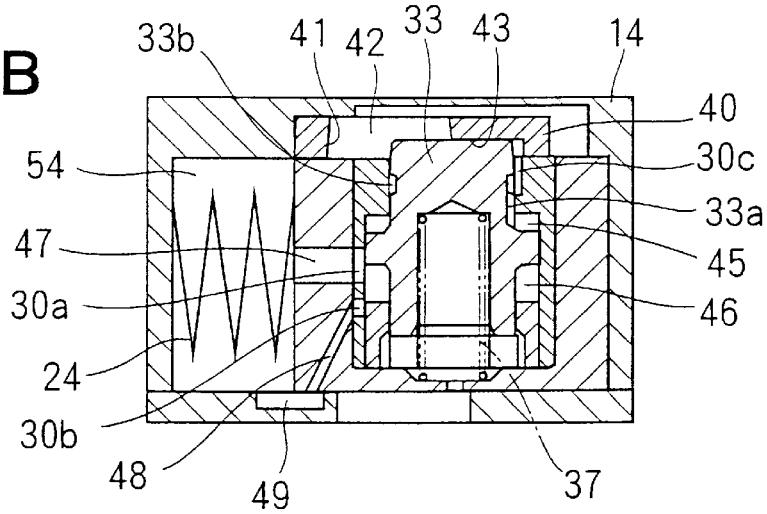
FIG. 6B is a cross-sectional view showing the stopper piston operation in which the stopper piston is fitted with an enlarged hole when the engine stops.

When the damper chamber 46 is opened, the stopper piston 32 moves toward the fitting hole 41 with the urging force of the spring 37. Halfway in the movement of the stopper piston 32 toward the fitting hole 41, the large-diameter portion 34 interrupts the communication between the through hole 30*a* and the oil pressure chamber 45. However, the oil passages formed by the groove 33*a,* annular groove 33*b* and groove 30*c* come into communication with one another and the oil pressure chambers 45, 42 are also put in communication with each other, so that the oil pressure chamber 45 is not sealed hermetically. Thus, the oil pressure chamber 45 does not act as a damper chamber. When the oil pressure chamber 45 communicates with the oil pressure chamber 42, no advance oil pressure is applied to the oil pressure chamber 45, so that the stopper piston 32 moves toward the fitting member 40 promptly with the advance oil pressure in the damper chamber 46. As shown in FIG. 6B, the stopper piston 32 having moved toward the fitting member 40 is first fitted into the enlarged hole 43.

As shown in FIGS. 6A and 6B, before fitting of the stopper piston 32 into the fitting hole 41, the seal lengths L1 and L2 shown in FIG. 5 are constant without change regardless a moving position of the stopper piston 32. Since the amount of operation oil flowing into the damper chamber 46 and the amount of operation oil flowing out of the damper chamber 46 do not change, force that the stopper piston 32 receives from the operation oil in the damper chamber 46 is constant.

Figure 6C:
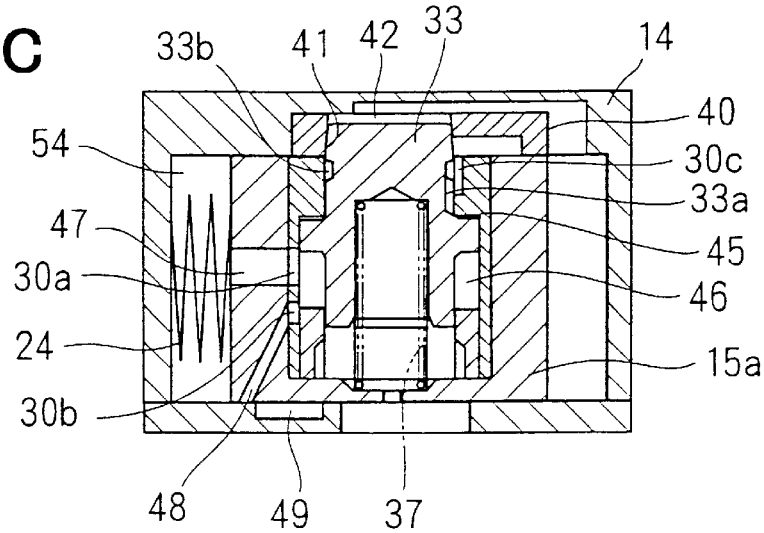
FIG. 6C is a cross-sectional view showing the stopper piston operation in which the stopper piston is fitted with a fitting hole when the engine stops.

Due to the load torque applied to the vane rotor 15 until the engine stop, the vane rotor 15 rotates to the retard side and reaches the intermediate position as in FIG. 6C, whereupon the stopper piston 32 is fitted into the fitting hole 41. As a result, a relative rotation of the vane rotor 15 with respect to the shoe housing 12 is restricted.

When the stopper piston 32 is fitted in the fitting hole 41 before start-up of the engine, the phase difference of the vane rotor 15 with respect to the shoe housing 12, i.e., the phase difference of the camshaft 2 with respect to the crank shaft, is held at an optimum phase most suitable for starting the engine, so that the engine starts in a short time with certainty.

Figure 7A:
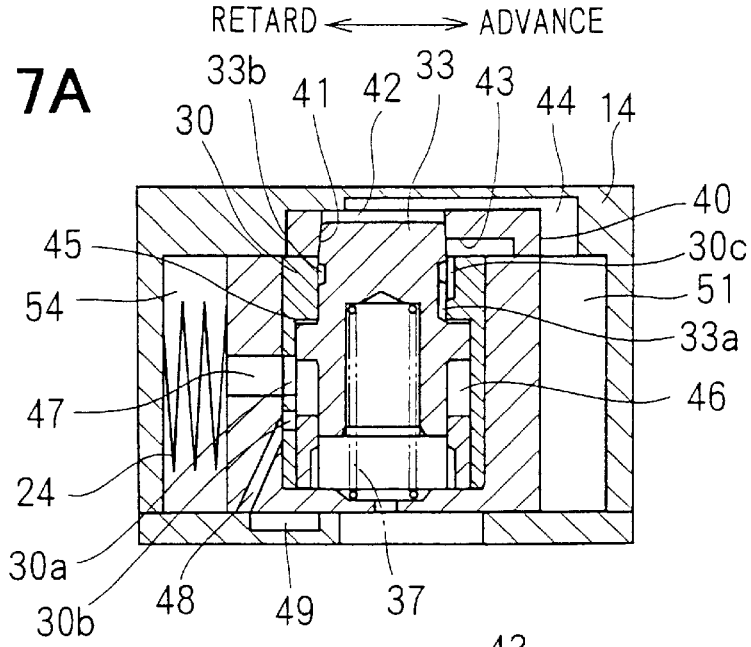
FIG. 7A is a cross-sectional view showing the stopper piston operation in which the stopper piston is fitted with the fitting hole when the engine starts.
Figure 7B:
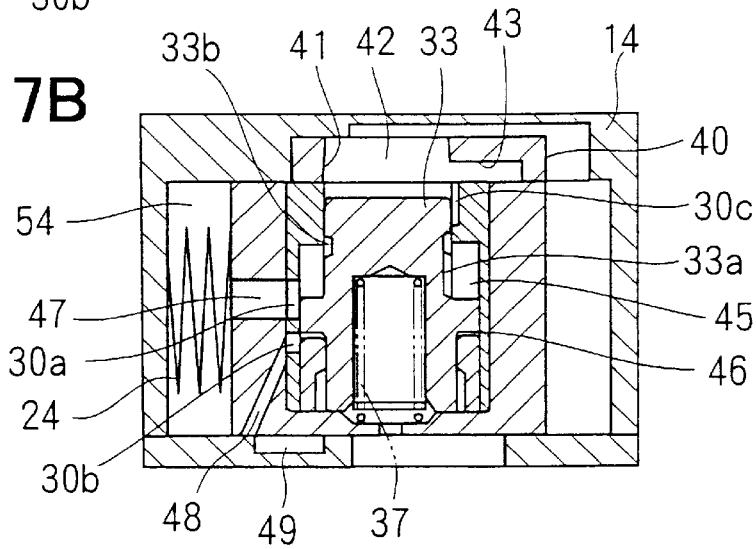
FIG. 7B is a cross-sectional view showing a released state of the stopper piston operation when the engine starts.
Figure 7C:
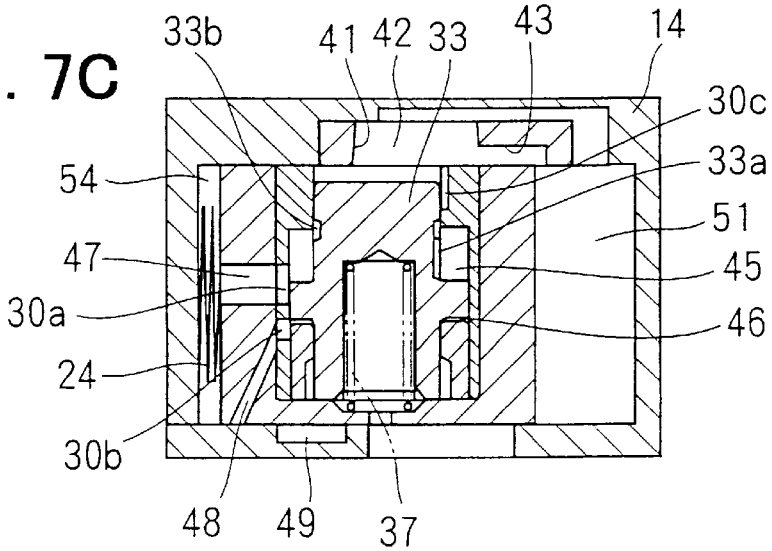
FIG. 7C is a cross-sectional view showing the stopper piston operation in which the stopper piston rotates from an intermediate position to a retard position when the engine starts.

During cranking for starting the engine, a valve portion 213*a* of the change-over valve 212 is selected, so that the operation oil is supplied to the retard oil pressure chambers 51, 52, 53 and the oil pressure chamber 42, and the advance oil pressure chambers 54, 55, 56 and the oil pressure chamber 45 are opened to the drain 211. However, until the retard oil pressure reaches a predetermined pressure, the stopper piston 32 does not come out of the fitting hole 41 and is held at a state shown in FIG. 7A.

After start-up of the engine, when the operation oil is charged into the retard oil pressure chambers 51, 52, 53 and the oil pressure in the oil pressure chamber 42 rises to a predetermined pressure, the stopper piston 32 comes out of the fitting hole 41, thereby allowing a relative rotation of the vane rotor 15 with respect to the shoe housing 12, i.e., phase control.

When the pressure of the operation oil rises to a sufficient level after start-up of the engine, any of valve portions 213*a,* 213*b* and 213*c* of the valve member 213 is selected in accordance with a command instructed by the ECU 300, whereby the supply of operation oil to the oil pressure chambers and the discharge thereof from the oil pressure chambers are controlled, and a relative rotation of the vane rotor 15 with respect to the shoe housing 12 is controlled.

While the engine is in normal operation, when the vane rotor 15 rotates to the retard side over the intermediate position, the communication between the oil passage 48 and the recess space 49 is interrupted by the sliding surfaces of the vane rotor 15 and the intermediate plate 17, so that the damper chamber 46 is sealed hermetically. Thus, even when the stopper piston 32 reaches the position on the fitting hole 41 of which position is the intermediate position, the stopper piston does not move toward the fitting hole 41 due to the damping action of the damper chamber 46.

When the vane rotor 15 rotates to the advance side over the intermediate position, the damper chamber 46 communicates with the advance oil pressure chamber 54 through the recess space 49, so that the damper chamber 46 does not exhibit its damping action any longer. However, since the operation oil is supplied into one of the oil pressure chambers 42, 45 and the stopper piston 32 undergoes a retard or advance oil pressure in a direction to come out of the fitting hole 41, the stopper piston 32 does not move toward the fitting hole 41. When the retard or advance oil pressure which the stopper piston 32 undergoes in its disengaging direction from the fitting hole 41 varies and drops, the stopper piston 32 might be fitted into the enlarged hole 43. However, when the vane rotor 15 reaches the intermediate position, the damper chamber 46 is sealed hermetically and exhibits the damping action, so that the stopper piston 32 does not fit into the fitting hole 41.

According to the above described embodiment, when the engine operates normally, the damper chamber 46 is sealed hermetically at the intermediate position as the abutting position, so that the stopper piston 32 is prevented from being fitted into the fitting hole 41. When the engine is stopped, the vane rotor 15 is advance-controlled, so that the stopper piston 32 rotates to advance side over the intermediate position. Thus, the damper chamber 46 is opened. Therefore, due to a drop in oil pressure caused by engine stop and by the action of a load torque, the stopper piston 32 rotates to the intermediate position from the advance side and is fit into the fitting hole 41 with certainty.

Further, since the oil chambers 42, 45 and the housing hole 38 facing the stopper piston 32, except the damper chamber 46, are not hermetically sealed and open constantly, the other fluid chambers than the damper chamber 46 are prevented from working as a damper chamber. Therefore, when the engine is stopped, by opening the damper chamber 46, the stopper piston 32 is fit into the fitting hole 41 with certainty.

In the above described embodiment, when the ignition key is turned OFF and engine stop is indicated, the supply of electric power to the ECU 300 is continued for a predetermined period of time and ECU 300 energizes the solenoid 215 to select the valve portion 213*c,* thereby allowing the operation oil to be supplied into the advance oil pressure chambers 54, 55, 56 to execute the advance control. Alternatively, the advance control may be executed by adopting an oil passage configuration in which when the valve portion 213*a* is selected, the operation oil is supplied into the advance oil pressure chambers, and when the valve portion 213*c* is selected, the operation oil is supplied into the retard oil pressure chambers. In this case, when the supply of electric power to the ECU 300 is cut off at the same time of turning OFF of the ignition key, the valve portion 213*a* is selected due to the urging force of the spring 214 and the operation oil is supplied into the advance oil pressure chambers.

In the above described embodiment, since the sliding surfaces of the vane rotor 15 and the intermediate plate 17 interrupts the communication between the damper chamber 46 and the advance oil pressure chamber 54, the damper chamber 46 is certainly switched between opening and closing at a predetermined relative rotational position of the vane rotor 15 with respect to the shoe housing 12. Further, there is no need to prepare any additional switching means, thereby preventing the number of parts from increasing.

In the above-described embodiment, the enlarged hole 43 is formed in the fitting member 40 in addition to the fitting hole 41. Alternatively, only fitting hole 41 may be formed without forming the enlarged hole 43.

In the above-described embodiment, the valve timing adjusting apparatus for actuating the intake valve is explained. Alternatively, the valve timing adjusting apparatus of the above-described embodiment may actuate only the exhaust valve or both intake valve and exhaust valve.

In the above-described embodiment, the stopper piston moves axially to be fit into the fitting hole, the stopper piston may move radially to be fit into the fitting hole. Moreover, the stopper piston may be accommodated at the housing member side, and the fitting hole and enlarged hole may be formed at the vane rotor side.

In the above-described embodiment, the rotational force of the crank shaft is transmitted to the camshaft through the chain sprocket. Alternatively, a timing pulley or a timing gear may be used. Further, the vane member may receive the driving force of the crank shaft as a driving shaft, and the camshaft as a driven shaft and the housing member may rotate integrally.

What is claimed is:

1. A valve timing adjusting device provided in a driving force transmission system which transmits a driving force from a driving shaft of an internal combustion engine to a camshaft which drives to open and close at least one of an intake valve and an exhaust valve, for adjusting opening-closing timing of at least one of said intake valve and said exhaust valve, comprising:

a driving-side rotor rotating together with said driving shaft of the internal combustion engine, said driving-side rotor including a housing chamber therein;

a driven-side rotor provided in said housing chamber and rotating together with said camshaft, said driven-side rotor including vanes partitioning said housing chamber into retard chambers and advance chambers, said driven-side rotor driven to rotate with respect to said driving-side rotor within a predetermined range of angle by a fluid pressure in said retard chambers and said advance chambers;

a restraining means including a contacting portion provided within said driven-side rotor and a contacted portion provided within said driving-side rotor, said restraining means restrains a relative rotation of said driven-side rotor with respect to said driving-side rotor when said contacting portion contacts said contacted portion while said driven-side rotor is at a predetermined angle position, said restraining means further including an urging means for urging said contacting portion toward said contacted portion;

a fluid chamber applying a fluid pressure to said contacting portion in a direction to cancel the contact between said contacting portion and said contacted portion;

a damper chamber formed around said contacting portion for decreasing a speed of movement of said contacting portion toward said contacted portion, and a changeover means for opening said damper chamber when said driven-side rotor is positioned at an advance side over the predetermined angle position with respect to the driving-side rotor, and for hermetically sealing said damper chamber when said driven-side rotor is positioned at the predetermined angle position or at a retard side over the predetermined angle position.

2. A valve timing adjusting device according to claim 1, wherein said contacting portion contacts said contacted portion when said driven-side rotor is at an intermediate position between both circumferential ends of the predetermined range of angle with respect to said driving-side rotor.

3. A valve timing adjusting device according to claim 1, wherein said vane partitions said housing chamber into retard chambers and advance chambers, said retard chambers apply a fluid pressure to said driven-side rotor to rotate toward the retard side with respect to said driving-side rotor, said advance chambers apply a fluid pressure to said driven-side rotor to rotate toward the advance side with respect to said driving-side rotor, said changeover means establishes and interrupts a communication between said retard chamber or said advance chamber and said damper chamber for switching between opening and sealing of said damper chamber.

4. A valve timing adjusting device according to claim 3, further including an advance control means for supplying an operation fluid to said advance chamber when said internal combustion engine is stopped.

5. A valve timing adjusting device according to claim 4, wherein the fluid pressure in said damper chamber is applied to said contacting portion to contact said contacted portion, and said damper chamber is opened when said damper chamber communicates with said advance chamber.

6. A valve timing adjusting device according to claim 3, wherein said changeover means includes said driving-side rotor and said driven-side rotor, a communication passage allowing said retard chamber or said advance chamber to communicate with said damper chamber is formed in said driving-side rotor or said driven-side rotor, and when said driven-side rotor is positioned at the advance side over the predetermined angle position with respect to said driving-side rotor, said communication passage allows said retard chamber or said advance chamber to communicate with said damper chamber.

7. A valve timing adjusting device according to claim 1, further including a support portion for supporting said contacting portion reciprocatably, wherein said contacting portion has a first small-diameter portion, a large-diameter portion and a second small-diameter portion successively in this order from said contacted portion, said support portion supports said first and second small-diameter portions and said large-diameter portion, a first fluid chamber is formed at a leading end of said first small-diameter portion, said first fluid chamber applies one of a fluid pressure which drives said driven-side rotor to the retard side with respect to said driving-side rotor and a fluid pressure which drives said driven-side rotor to the advance side with respect to said driving rotor to said first small-diameter portion, a second fluid chamber is formed at a contacted portion side of said large diameter portion, said second fluid chamber applies the other fluid pressure to said large-diameter portion, said damper chamber is formed in said large-diameter portion at a side opposite to said contacted portion, and fluid pressures in said first and second fluid chambers are applied in a direction to cancel the contact between said contact portion and said contacted portion.

8. A valve timing adjusting device according to claim 1, wherein fluid chambers, except said damper chamber, facing said contacting portion are opened regardless a relative rotational position of said driven-side rotor with respect to said driving-side rotor.

9. A valve timing adjusting device provided in a driving force transmission system which transmits a driving force from a driving shaft of an internal combustion engine to a camshaft which drives to open and close at least one of an intake valve and an exhaust valve, for adjusting opening-closing timing of at least one of said intake valve and said exhaust valve, comprising:

a driving-side rotor rotating together with said driving shaft of the internal combustion engine, said driving-side rotor including a housing chamber therein;

a driven-side rotor provided in said housing chamber and rotating together with said camshaft, said driven-side rotor including vanes partitioning said housing chamber into retard chambers and advance chambers, said driven-side rotor driven to rotate with respect to said driving-side rotor within a predetermined range of angle by a fluid pressure in said retard chambers and said advance chambers;

a restraining means including a contacting portion provided within said driven-side rotor and a contacted portion provided within said driving-side rotor, said restraining means restrains a relative rotation of said driven-side rotor with respect to said driving-side rotor when said contacting portion contacts said contacted portion while said driven-side rotor is at a predetermined angle position, said restraining means further including an urging means for urging said contacting portion toward said contacted portion;

fluid chambers applying fluid pressure to said contacting portion in a direction to cancel the contact between said contacting portion and said contacted portion; and a damper chamber formed around said contacting portion for decreasing a speed of movement of said contacting portion toward said contacted portion, wherein fluid chambers, except said damper chamber, facing said contacting portion are opened regardless a relative rotational position of said driven-side rotor with respect to said driving-side rotor.

10. A valve timing adjusting device according to claim 9, further including a support portion for supporting said contacting portion reciprocatably, wherein said contacting portion has a first small-diameter portion, a large-diameter portion and a second small-diameter portion successively in this order from said contacted portion, said support portion supports said first and second small-diameter portions and said large-diameter portion, a first fluid chamber is formed at a leading end of said first small-diameter portion, said first fluid chamber applies one of a fluid pressure which drives said driven-side rotor to the retard side with respect to said driving-side rotor and a fluid pressure which drives said driven-side rotor to the advance side with respect to said driving rotor to said first small-diameter portion, a second fluid chamber is formed at a contacted portion side of said large diameter portion, said second fluid chamber applies the other fluid pressure to said large-diameter portion, said damper chamber is formed in said large-diameter portion at a side opposite to said contacted portion, fluid pressures in said first and second fluid chambers are applied in a direction to cancel the contact between said contact portion and said contacted portion, and a communication means is provided for allowing said first fluid chamber to communicate with said second fluid chamber when said contact portion moves to contact said contacted portion.

11. A valve timing adjusting device according to claim 10, wherein said communication means includes grooves formed in an outer wall of said first small-diameter portion and an inner wall of said support portion.

12. A valve timing adjusting device according to claim 11, wherein said grooves extend in a reciprocating direction of said contacting portion, and an annular groove is formed in the outer wall of said first small-diameter portion or in the inner wall of said support portion so as to connect with said grooves.

13. A valve timing adjusting device according to claim 10, wherein when an area at which said first small-diameter portion receives the fluid pressure from said first fluid chamber in the direction to cancel the contact between said contacting portion and said contacted portion is S1, an area at which said large-diameter portion receives the fluid pressure from said second fluid chamber in the direction to cancel the contact between said contacting portion and said contacted portion is S2, and an area at which said large-diameter portion receives the fluid pressure from said damper chamber in the direction of allowing said contacting portion to contact said contacted portion is S3, there exists a relationship of $S1 \approx S2 \approx S3$.

14. A valve timing adjusting device according to claim 10, wherein when a clearance between an outer wall of said large-diameter portion and an inner wall of said support portion is C1, and a clearance between an outer wall of said second small-diameter portion and the inner wall of said support portion is C2, there exists a relationship of $C1<C2$.

15. A valve timing adjusting device according to claim 10, wherein when a seal length between an outer wall of said large-diameter portion and an inner wall of said support portion is L1, and a seal length between an outer wall of said second small-diameter portion and the inner wall of said support portion is L2, there exists a relationship of $L1>L2$.

16. A valve timing adjusting device according to claim 15, wherein, before the contact between said contacting portion and said contacted portion, the seal lengths L1 and L2 are constant regardless a movement position of said contacting portion.

* * * * *